United States Patent [19]

Dyer

[11] 4,219,900

[45] Sep. 2, 1980

[54] PIVOTING NOZZLE DUCT

[75] Inventor: Robert F. Dyer, Rancho Palos Verdes, Calif.

[73] Assignee: The Hoover Company, North Canton, Ohio

[21] Appl. No.: 61,687

[22] Filed: Jul. 30, 1979

Related U.S. Application Data

[63] Continuation of Ser. No. 914,036, Jun. 9, 1978, abandoned.

[51] Int. Cl.[3] ..... A47L 9/00

[52] U.S. Cl. ..... 15/339

[58] Field of Search ..... 15/334, 335, 339, 347, 15/350, 351, 354–373, 383, 384, 389, 391, 412, 413; 285/7

[56] References Cited

U.S. PATENT DOCUMENTS

| | | | |
|---|---|---|---|
| 2,175,647 | 10/1939 | Replogle | 15/347 X |
| 2,618,007 | 11/1952 | Fuller | 15/412 X |
| 2,898,622 | 8/1959 | Hurd | 15/334 X |
| 3,634,905 | 1/1972 | Boyd | 15/413 X |
| 3,675,268 | 7/1972 | Nordeen | 15/350 |
| 3,962,746 | 6/1976 | Johnson et al. | 15/413 X |

*Primary Examiner*—Christopher K. Moore

[57] ABSTRACT

The invention includes a nozzle body for a floor care appliance having a housing. A fill duct is pivotally mounted within the nozzle body for pivotal movement out of the housing to permit declogging and cleaning of it.

7 Claims, 3 Drawing Figures

PIVOTING NOZZLE DUCT

This is a continuation of Application Ser. No. 914,036, filed June 9, 1978, now abandoned, and entitled "PIVOTING NOZZLE DUCT".

BACKGROUND OF THE INVENTION

1. Field of the Invention

This invention relates to floor care appliances and, more specifically, relates to a nozzle arrangement having a rigid pivotal duct accessible for clean out purposes.

2. Description of the Prior Art

Dirt clogging of cleaners has long been a problem in the floor care art. Much work has been done to eliminate these clogs that are capable of being formed anywhere between the suction nozzle mouth and to and within the bag, itself. For example, specific design modifications to cure clogging in the dirt transport system between the bag and suction mouth have included; streamlining of the air flow within the ducting, increasing the cross sectional area of the flow path and providing by some means for a clean out function to aid the operator in clearing obstructions.

These last arrangements have taken the form, in some cases, of the utilization of removable ducting that thereby yields a more or less convenient accessibility to the dirt clog in the duct. Other of these structures include flexible bellows-like ducts found in the nozzle body. However, some nozzle body ducting is not easily made flexible because of the type of seal necessary for proper air flow or because a rigid duct offers a more streamlined, clog-free flow path than a bellows-type duct.

Accordingly, it is an object of this invention to provide a pivotal nozzle body duct to provide accessibility for clean out purposes.

It is a further object of the invention to provide a rigid nozzle body duct having a rotatable sealed mounting.

It is a further object of the invention to provide a pivotally and sealingly mounted rigid duct capable of pivoting to an accessible location for clean out purposes.

It is a still further object of the invention to provide a pivoting duct which may be sealingly maintained to the agitator chamber and suction side of the motor fan system.

BRIEF DESCRIPTION OF THE INVENTION

The invention comprehends a vacuum cleaner having a nozzle body including a housing. An agitator chamber is formed at the front end of the nozzle body having a port for communicating rearwardly with a motor-fan system that provides a flow of suction air for cleaning purposes. The motor-fan system includes a rotary sealing means at its suction side that pivotally and receivingly mounts a rigid duct that communicates forwardly with the agitator chamber.

A gasket is provided on the front end of the duct to seal it to the agitator chamber. A bottom plate mounted on the housing fits over the agitator chamber and includes aperture means to permit extension of a conventional rotatable agitator mounted in the agitator chamber. This bottom plate prevents the pivoting motion of the duct unless removed. Downward pivoting of the duct, after bottom plate removal, provides accessibility to any clogs present in the duct.

BRIEF DESCRIPTION OF THE DRAWINGS

Reference may now be had to the accompanying drawings for a better understanding of the invention, both as to its organization and function, with the illustration being of a preferred embodiment, but being only exemplary, and in which.

DETAILED DESCRIPTION OF THE INVENTION

Figure 1:
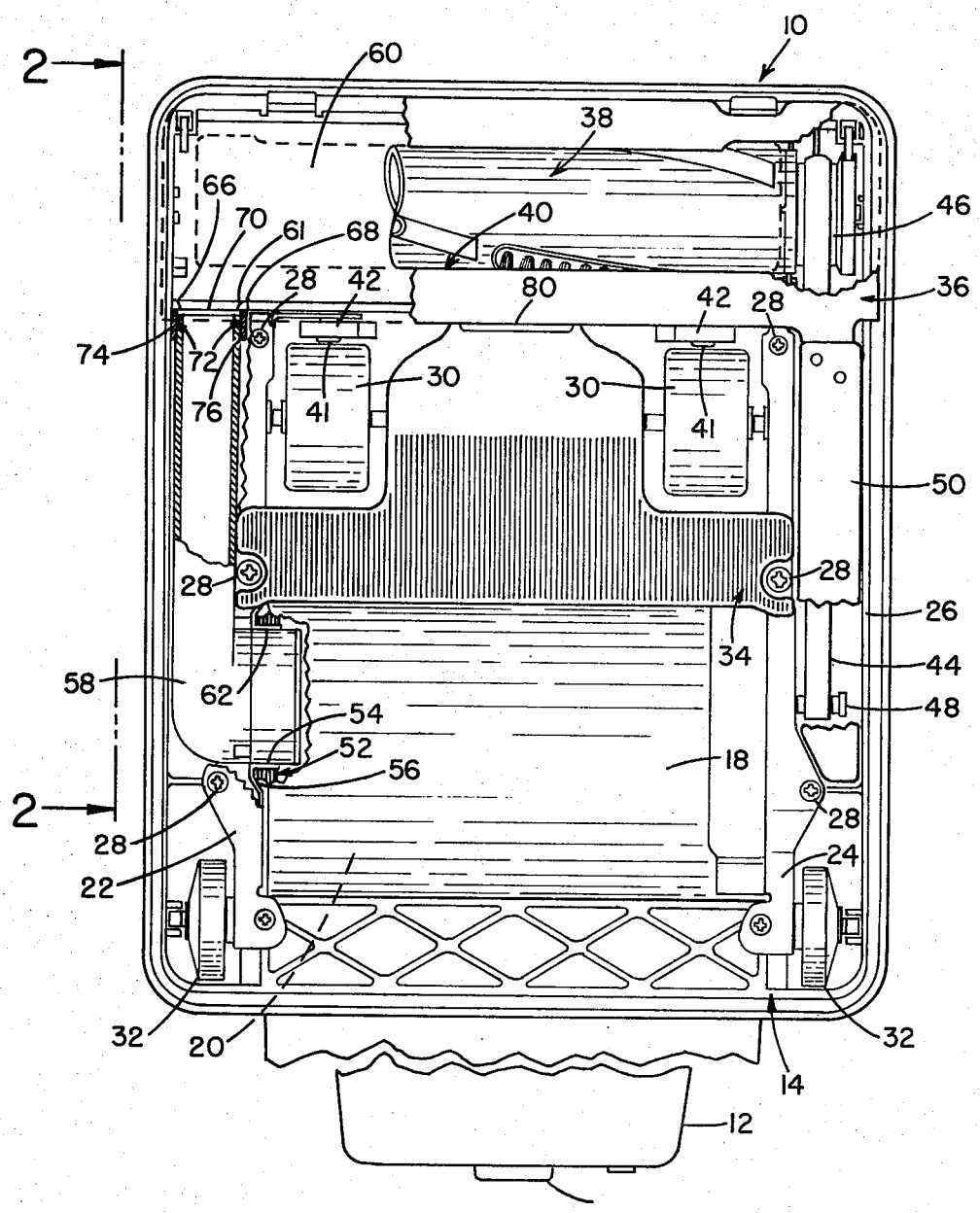
FIG. 1 is a bottom plan view, partly in section, of a cleaner incorporating the invention.

There is shown in FIG. 1, a cleaner 10 having a hard bag 12 and a nozzle body 14 pivotally connected thereto. A handle 16 extends from the upper end of the hard bag 12 for easy grasping by the user of the cleaner 10. Hard bag 12 includes at its lower termination a partially cylindrical section 18 that mounts a motor-fan 20 that provides suction for the cleaner 10.

Mounted within the nozzle body 14 are a pair of substantially flat reinforcing legs 22, 24 that attach to downwardly extending ribs (unnumbered) on housing 26 of the nozzle body 14. A series of screws 28 provide the requisite holding function. The reinforcing legs 22, 24 extend longitudinally generally fore and aft within the housing 26 to provide support for it in the same direction.

Forward and rearward rollers 30, 30 and 32, 32, respectively, are mounted with the legs 22, 24 to movingly support the cleaner 10 when it traverses the surface being cleaned. The rollers 30, 30 are larger than and mounted inboard of the rollers 32, 32 so that good tracking and ease in manipulation is achieved.

A cover plate 34 extends between the front rollers, 30, 30 and rearwardly therefrom to adjacent the location of the cylindrical section 18 to close off the underside of the nozzle body 14 in this area. Screws 28 serve as the fastening means for cover plate 34. Forwardly of the cover plate 34, a bottom plate 36 extends generally transversely to the nozzle body 14 to cover, conventionally, the front bottom portions of the cleaner 10 and to permit the mounting of an agitator 38 therebelow, the same extending through a large slot 40 in bottom plate 36. The bottom plate 36, through tabs 41, 41, is removably attached to nozzle body 14 by means of conventional spring latches 42, 42 pivoted to inward and upwardly projecting portions (not shown) of reinforcing legs 22, 24. By this arrangement the bottom plate 36 is removable for access to the agitator 38 and also for a purpose to be later described.

Agitator 38 is driven, as is usual, by an endless belt 44 that extends around the agitator on a journalling portion 46 and, in turn, is driven by a shaft 48 extending out of the cylindrical section 18 within which is housed the driving motor-fan 20. The bottom plate 36 includes an extension 50 that projects rearwardly to cover and protect the belt 44 in its rearward extension.

The cleaner 10 in so far has been described as substantially conventional. The description will now proceed covering its less conventional structure and including what are considered the inventive aspects of this Application.

In order to pivotally mount the cylindrical section 18 of the rigid bag 12 to the nozzle body, a circular hollow short boss 52 (only one shown) is formed integrally on each side of the cylindrical section 18. The circular boss 52 adjacent reinforcing leg 22 receives therein a circular projection 54 formed on or attached to reinforcing leg 22 with the boss 52 seating against a flange on the leg 22. Since the reinforcing legs 22, 24 are mounted fixed with respect to nozzle body 14, a durable secure pivoting is obtained for the short bosses 52 and thereby the rigid bag 12.

A rigid duct 58 is provided extending forwardly from cylindrical section 18 to an agitator chamber 60. At its rear, duct 58 is insertedly journalled within a bore 62 in circular projection 54 of the reinforcing leg 22 so as to be capable of pivotal motion to accommodate relative movement between nozzle body 14 and rigid bag 12.

Figure 2:
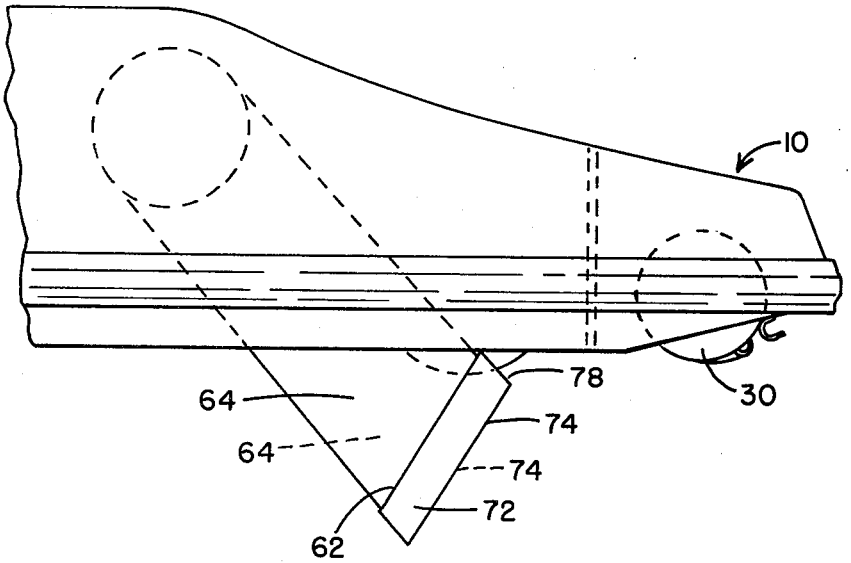
FIG. 2 is a side view of the nozzle body taken on line 2—2 of FIG. 1 but showing the duct rotated to an accessible position.
Figure 3:
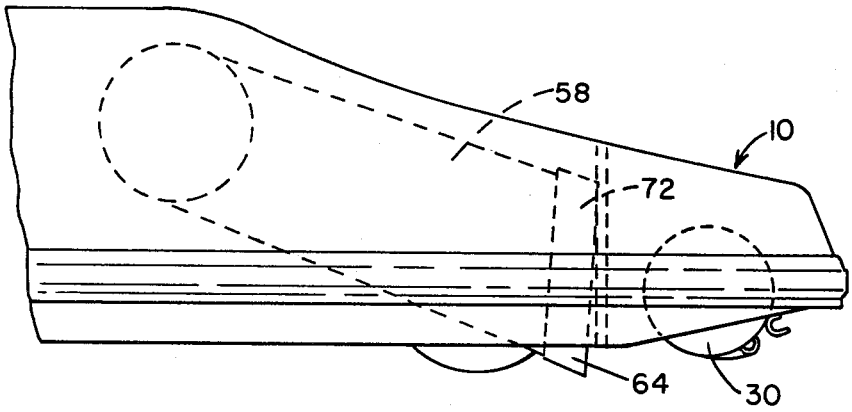
FIG. 3 is a view like FIG. 2 but with the duct rotated to nearly complete sealed position.

Duct 58 also is capable of independent pivoting movement (FIGS. 2 and 3), as journalled by circular projection 54, outwardly of a plane formed by the lower termination of nozzle housing 26. This, upon removal of the obstructing (FIG. 1) bottom plate 36 from the nozzle housing 26. Thus, duct 58 may be pivoted away from its juncture with agitator chamber 60 so that the free end of the same is easily available to the operator to permit access to its interior for clog removal and clean out purposes.

Rigid duct 58 has at its forward portion a slanted end 62 including a pair of vertical, slanting sidewalls 64, 64. This slanting end insures a close conformance of the duct end, upon final pivotal swinging, with agitator chamber 60 in the area of its port 61. This conformance is had by the provision of a pair of vertically extending flange walls 66, 68 integral with nozzle housing 26 and within which slanted end 62 nests. A horizontally extending flange 70 (at the bottom in FIG. 1) also may be provided, if desired, to form with flange walls 66, 68 an open U-shaped reception means for the end 62.

To insure sealing at this location a gasket 72 also of U-shape is mounted on the forward termination of slanted end 62. This gasket includes vertical legs 74, 76 and horizontal leg 78 to provide the U-shape for the gasket, with the gasket disposed as far forwardly as possible relative to slanted end 62 (slightly forwardly thereof) so that the gasket abuts the flange walls 66, 68 and 70 along two legs and the bight of the U-shape. A reasonably air tight sealing arrangement is formed thereby so that suction losses between the agitator chamber 60 and duct 58 are minimized.

The bottom plate 36 has a trailing edge 80 disposed rearwardly of the joint formed between the agitator 60 and the rigid duct 58 so that it overlaps this juncture and maintains the rigid duct 58 in sealed position. Removal of this bottom plate, then, permits pivoting of the rigid duct 58 to the position of FIG. 2 for clean out purposes.

It should be obvious that the objects of the invention have been complied with by the specific embodiment described. It should also be obvious that many variations of the disclosed invention could be made by one skilled in the art which would stillcome within the scope and purview of the invention.

What is claimed is:

1. In a nozzle body, the combination including;

(a) a housing for said nozzle body extending from front to rear thereof, (b) a rigid suction duct extending within said housing from front to rear thereof a substantial distance and communicating a suction source and a working area of said nozzle, (c) said rigid duct pivotally mounted relative to said nozzle body at a pivot on said nozzle body and said rigid duct occasionally being clogged with dirt and dust taken in at said nozzle working area, (d) said rigid duct being freely pivotable outwardly of the confines of said nozzle body on said pivot for declogging and clean out purposes, (e) said duct being of elongated configuration, (f) a slanted portion on the end of said duct, slanting with respect to said elongation, and (g) a conforming means for providing said communication, said slanted portion cooperating with said conforming means to provide a full seal.

2. The combination set out in claim 1 wherein;

(a) an upper bag housing is provided pivoted to said nozzle body at said pivot.

3. The combination set out in claim 1 wherein;

(a) said full seal includes a gasket disposed on one of said conforming means and said slanted portion.

4. In a nozzle assembly for a suction cleaner, the combination including;

a housing, an agitator chamber within said housing and having a downwardly directed inlet opening and an outlet opening spaced from said inlet opening, a rigid, elongated suction duct within said housing establishing communication between a suction source and said agitator chamber through said chamber outlet opening, said duct being pivotally mounted on said housing at a place spaced from said agitator chamber and having its free end normally in communication with said chamber outlet opening and said duct being pivotable away from said chamber outlet opening to project its free end downwardly and outwardly of said housing thereby facilitating the removal of any clogging debris from said duct and said chamber outlet opening, and gasket means interposed between the free end of said duct and defining margins of said chamber outlet opening to insure entry of air into said duct only through said chamber outlet opening.

5. The combination set out in claim 4 wherein said nozzle assembly includes;

a bottom plate covering a portion of the bottom of said housing, said bottom plate being pivotable to permit said pivoting of said duct away from said chamber opening.

6. In a nozzle body, the combination including;

(a) a housing for said nozzle body extending from front to rear thereof, (b) a body forming an agitator chamber in said housing, (c) a rigid suction duct extending within said housing from front to rear thereof a substantial distance and communicating a suction source and said agitator chamber, (d) said rigid duct pivotedly mounted relative to said nozzle body at a point on said nozzle body and said rigid duct occasionally being clogged with dirt and dust taken in at said agitator chamber, (e) said rigid duct being freely pivoted outwardly of the confines of said nozzle body on said pivot for declogging and cleanout purposes, (f) and a gasket interposed between said duct and said body forming said agitator chamber to seal the duct thereto.

7. In a nozzle body, the combination including;

(a) a housing for said nozzle body extending from front to rear thereof, (b) a rigid suction duct extending within said housing from front to rear thereof a substantial distance and communicating a suction source and a working area of said nozzle, (c) said rigid duct pivotedly mounted relative to said nozzle body at a pivot on said nozzle body and said rigid duct occasionally being clogged with dirt and dust taken in at said nozzle working area;

(d) said rigid duct being freely pivotable outwardly of the confines of said nozzle body on said pivot for declogging and cleanout purposes, and (e) a gasket disposed between and end of said freely pivotable rigid duct and said working area of said nozzle to provide a seal therebetween.

* * * * *